US006569032B1

(12) United States Patent
Haliyo

(10) Patent No.: US 6,569,032 B1
(45) Date of Patent: May 27, 2003

(54) GOLF PUTTER

(76) Inventor: Isak Haliyo, Sadef Street 47, 2nd Floor, #15, Atatlar, Istanbul (TR)

( * ) Notice: Subject to any disclaimer, the term of this patent is extended or adjusted under 35 U.S.C. 154(b) by 0 days.

(21) Appl. No.: 09/634,824

(22) Filed: Aug. 9, 2000

(30) Foreign Application Priority Data

Aug. 14, 1999 (GB) ..... 9919193

(51) Int. Cl.[7] ..... A63B 53/02; A63B 53/04
(52) U.S. Cl. ..... 473/313; 473/314; 473/340
(58) Field of Search ..... 473/313, 341, 473/342, 324, 349, 350, 251, 340, 314

(56) References Cited

U.S. PATENT DOCUMENTS 4,010,958 A * 3/1977 Long ..... 473/341
4,199,144 A * 4/1980 Skelly
4,548,678 A * 10/1985 Laflin
4,693,478 A * 9/1987 Long
4,795,158 A * 1/1989 Kuykendall ..... 473/201
4,871,174 A * 10/1989 Kobayashi ..... 473/252
5,001,008 A * 3/1991 Tokita
5,362,047 A * 11/1994 Shaw
5,716,290 A * 2/1998 Baker
5,899,817 A * 5/1999 Dunikoski
5,938,543 A * 8/1999 McGeeney
5,967,904 A * 10/1999 Nagai
5,993,324 A * 11/1999 Gammil ..... 473/251
6,024,652 A * 2/2000 Westbrook
6,095,931 A * 8/2000 Hettinger
6,171,203 B1 * 1/2001 Huang ..... 473/305
6,203,443 B1 * 3/2001 Britton
6,273,827 B1 * 8/2001 Hockerson

* cited by examiner

*Primary Examiner*—Stephen Blau
(74) *Attorney, Agent, or Firm*—Edwin D. Schindler

(57) ABSTRACT

A putter head comprising a back portion and a front portion, the front portion being of substantially lower density material than the back portion and said front portion superimposing said back portion and defining substantially the entire striking face of the putter.

23 Claims, 2 Drawing Sheets

GOLF PUTTER

FIELD OF THE INVENTION

This invention relates to putter heads which are typically attached to a shaft and used in a variety of games to propel a hard ball over a course or links. Reference will be made hereinafter to the game of golf but it should be understood that the invention is not restricted to such and has applications in other sports such as croquet or pitch-and-putt.

BACKGROUND OF THE INVENTION

The putting green is an area of a golf course typically comprising closely cropped grass surrounding a hole. Using a golf club known as a putter, the ball is given a gentle stroke known as a putt and the smooth surface of the putting green is designed to facilitate progress of the hall into a hole. Putting is often purported to be the most difficult aspect of the game and the stroke requiring the greatest degree of skill.

Generally at least two putts are required by competent players in order to hole a golf ball. It will be appreciated that those less skilled in the art of golf may require many more shots in order to hole the ball.

Many advanced and professional golfers possess numerous putters in their collection. This implies that individual requirements change and this is influenced in part by experience, age and physical abilities.

The advantages of a golf putter wherein the center of gravity is to the rear of the putter head are well known in the art. Such a design enhances performance of the golfer enabling him to strike the ball with an improved "pendulum swing." Due to the specific weight distribution, the putter lends itself to be swung in a manner which resembles a pendulum which is found to be the most effective stroke with which to hit the ball, allowing for a cleaner strike. The player gets the ball rolling sooner which is an essential feature for better putting.

In the light of these design constraints attention has focused on weight distribution within the putter head with respect to the specific materials employed in manufacture. A known putter incorporates an insert of plastics material into a trough shaped putter head which is typically made of metal such as brass, steel, aluminum or some other relatively rigid material. Since the plastic insert is six to seven times lighter than any metal, the centre of gravity is automatically re-positioned towards the lower back of the putter head.

Another benefit of using a plastic insert on the face of the putter is that it re-creates the soft feeling of the old balata-type golf balls which have now been replaced by durable hard balls.

Upon swinging the putter, the player supplies kinetic energy which is transferred into forward rotational movement of a golf ball resting on a playing surface so as to elicit a predictable line of travel. This process is dependent on transferring the kinetic energy at exactly the correct spot, hereinafter referred to as the 'sweet spot', from the putter head to the golf ball.

The disadvantage of the above mentioned known putter is that this design creates a 'sweet spot' which is within the plastic insert and which is comparatively small relative to the total area of the putter. In order to strike the ball most effectively the golfer must target the ball with this specific spot. Understandably this goal is very difficult to attain, especially for the novice.

Another disadvantage of the above mentioned putter is in their production which is expensive, complicated and time-consuming. The first step is the production of a 'cavity' on the face of the putter. This cavity can be made during the moulding process of the metal but a final 'routing' is necessary for precise results. The second step involves pouring liquid plastic polymer into the cavity in either a 'hot' or 'cold' stage. During this process air bubbles often get trapped in the insert. These air bubbles are made apparent during the final face-milling process and result in a defective putter. The third step of production involves overnight storage of the product to allow it to reach a stable state before the final face milling operation.

STATEMENT OF THE INVENTION

According to the present invention there is provided a putter head suitable for attachment to a shaft comprising a back portion and a front portion, said front portion being of substantially lower density material than said back portion, said front portion superimposing said back portion and defining substantially the entire striking face of the putter.

The advantage of a putter of the present invention is that it avoids the inherent problem of the known putter whereby upon failing to target the ball with the sweet spot defined by the plastic insert, the golfer strikes the ball with a mixture of metal and plastics. In this way the material striking the ball and subsequently the force supplied to the ball is not uniform and it travels forward in the direction according to which the greatest force is supplied. This will inevitably lead to large distance variations between subsequent shots.

In a putter of the present invention the front portion covers the back portion which is not exposed at any part of the striking face. Even if the golfer misses the sweet spot, the design of the putter is such that it offers a striking surface which is uniform with respect to the type of material contacting the ball. Accordingly, a putter of the present invention allows for more predictable forward motion of the ball whereby striking the ball other than at the sweet spot may cause the player to miss the hole but shots will be in the same range.

A golf putter of the present invention also offers significant benefits in terms of production because the back and front portions of the putter are made separately and then simply joined together using standard techniques. Production is fast, economical and results in a minimal number of defective products. The sophisticated production techniques of plastic inserted putters are altogether avoided.

Preferably the back portion of the putter is made of metal and the front portion is made of hard plastics material. Most preferably the front portion is made of a polymer of any one of or a combination of melamine-formaldehyde, phenol formaldehyde, polyester, acrylic, polyurethane or epoxy type materials. Preferably the polymer is high pressure laminate.

If a melamine-formaldehyde or phenol formaldehyde polymer is used (both resin based), cellulose is employed as the filling material. This gives body to the polymer. Alternatively, if a polyester or acrylic polymer is used, the filling material is usually Aluminum Trihydrate $Al(OH)_3$. In the case of an epoxy or polyurethane polymer, each can be used independently in a 100% resin formulation, or each can be incorporated into formulations with mineral fillers like $CaCO_3$, talc or dolomite. Mixing the product with calcite minerals allows for the production of a material with different strength characteristics.

The thickness of the front portion can vary from 5 mm to 15 mm but is preferably from 6 mm to 12 mm. Most preferably the thickness of the front portion is 10 mm.

A putter of the present invention also offers significant benefits in terms of weight redistribution in the putter head. In a known putter with a plastic insert, 10%–20% of the putter head volume is replaced by plastic materials. This is not sufficient to move the center of gravity as far back as desired. By way of compensation, manufacturers use heavy metal inserts, such as tungsten, at the back of the putter head. This measure adds further complications to the production process and greatly increases production costs.

In a putter of the present invention 45% to 55% of the head volume is made of plastic which corresponds to 15% to 19% of the total weight. Preferably 50% of the head volume is made of plastic which corresponds to 17% of the total weight. Weight is canalised to the rear of the putter head, thus targeting the center of gravity into the required position at the back and lower points as desired. In order to achieve these results the putter does not have to be heavier than 300 g. This is an advantage because heavy putters cause problems on fast greens.

DETAILED DESCRIPTION OF THE INVENTION

The present invention will now be described by way of example only with reference to the accompanying drawings.

Figure 1:
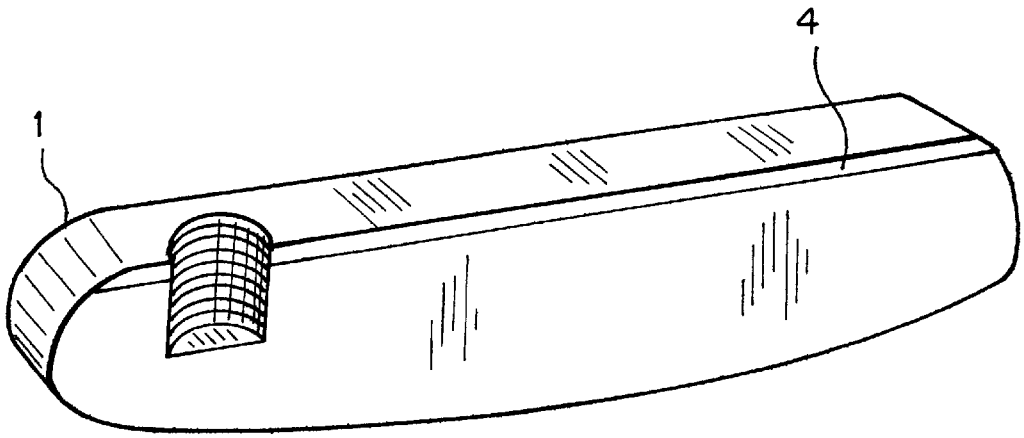
FIG. 1 illustrates in side elevation the front portion 1 of a golf putter according to the present invention.
Figure 2:
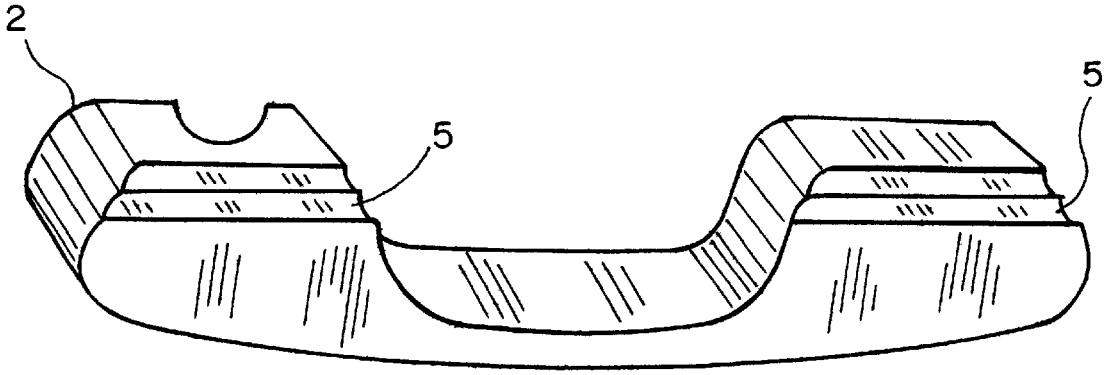
FIG. 2 illustrates in side elevation the back portion 2 of a golf putter according to the present invention.
Figure 3:
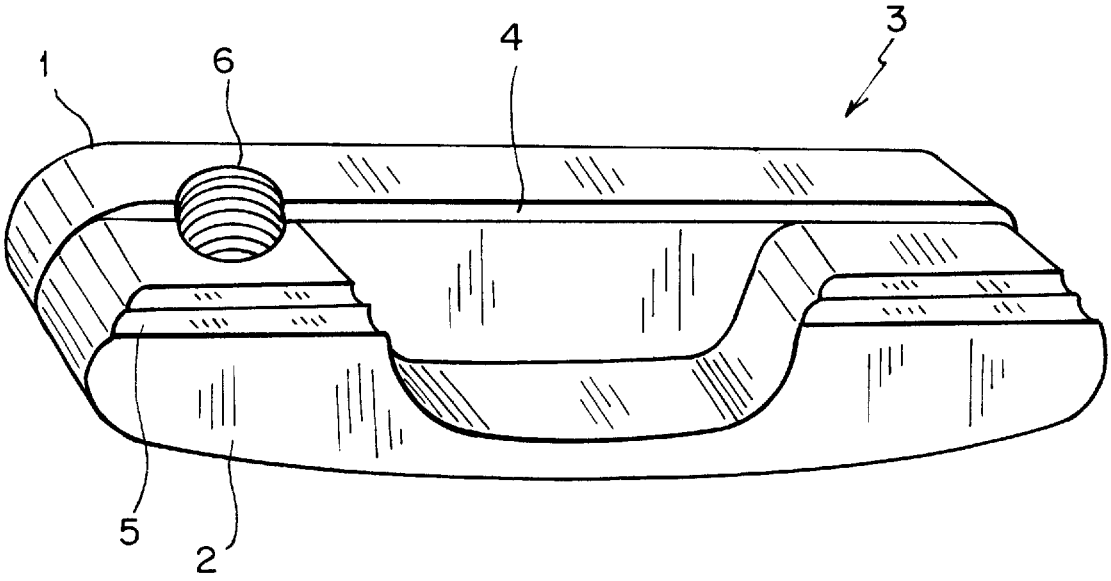

FIG. 3 illustrates in side elevation a rear view of an assembled golf putter 3 according to the present invention comprising front portion 1 and back portion 2.

Figure 4:
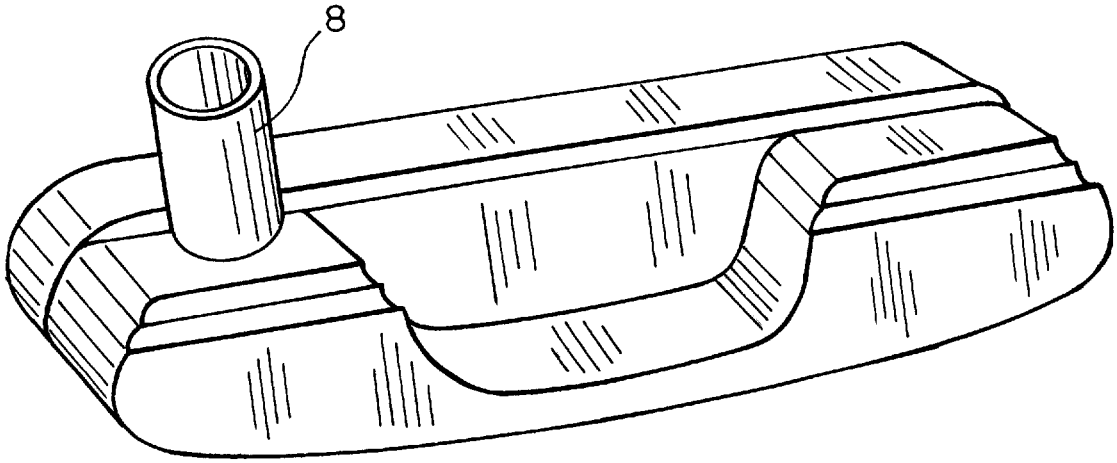

FIG. 4 illustrates in side elevation a rear view of an assembled golf putter 3 according to the present invention attached to a shaft 8.

The front position 1 of the putter can be made from any hard wearing plastics material that is able to withstand the force that it would be subjected to upon striking the golf ball. A suitable material will be weather resistant, widely available and easy to work. The weight of the front portion should also be substantially less than that of the back portion so that when the putter is assembled the center of gravity lies to the rear of the putter. It should be understood that each material will give a different "feel" with the ball and as such can be chosen in accordance with the particular personal preference of the golfer.

The front portion is made of any one or a combination of melamine-formaldehyde, phenol formaldehyde, polyester, acrylic, polyurethane or epoxy-type materials. These may be cut from pre-produced sheets or made from pre-cast shaped parts.

In one embodiment of the invention front portion 1 is made of high pressure laminate comprising approximately 25% phenolic resin and 75% cellulose. Standard production techniques are used whereby sheets of cellulose are immersed on a resin and subjected to high pressure polymerisation.

The use of a high pressure laminate carries additional benefits from an aesthetic point of view in that this material can be finished to achieve a range of very different appearances according to the particular taste preferences of the golfer such as a wood finish or a granite look.

The thickness of front portion 1 can vary from 5 mm up to 15 mm but is preferably from 6 mm to 12 mm. In one embodiment of the invention the thickness of the front portion is 10 mm. Tests reveal this thickness to be the optimum in that it allows for sufficient depth at the sweet spot with which to strike the ball and also to cover the face of the back portion 2 when the putter is assembled as shown in FIG. 3.

The back portion 2 of the putter is typically made of metal such as brass, steel, aluminium or some other relatively rigid material such as graphite or a ceramic composite The thickness of this portion can range from 10 mm to 20 mm. In one embodiment of the invention the thickness of the back portion is 16 mm.

In a preferred embodiment of the invention the back portion is made of brass with a specific gravity of 8. The high pressure laminate forming front portion 1 has a specific gravity of 1.4. The total weight of the putter head will typically range from 250 g to 300 g with a preferred weight range from 280 g to 285 g. 50 g or 17% of the total weight is attributable to the weight of front portion 1 of high pressure laminate. This corresponds to 50% of the total volume of the putter head.

Tests reveal that this combination of specific gravity and weight ratios provide an optimum feel although it should be understood that the invention is not limited as such since this feature is extremely subjective and will vary depending on the particular preference of the golfer.

As shown in FIG. 3 the shapes of the front and back portion are such that when the putter is assembled, front portion 1 superimposes back portion 2 so that the material comprising the back portion is not exposed at any part of the striking surface which is defined by front portion 1.

Back portion 2 is trough shaped whereby the area of the trough indent delimits the 'sweet spot' of the putter on the superimposed front portion which defines the striking face of the putter.

The top side of front portion 1 has a ridge 4 extending along its length which aids in the alignment of the two components when they are secured together. The two sides of the trough of back portion 2 abut the ridge at their uppermost part so that when the putter is in the assembled form the only part of front portion 1 which is not backed by portion 2 is that area which corresponds to the indent of the trough and this narrow ridge section 4.

Back portion 2 is provided with a stepped portion 5 in each side of the trough which runs parallel to the plane of this component and in alignment with ridge 4 of portion 1. In a preferred embodiment each side of the trough is provided with two steps each of equal height. This feature serves to improve weight distribution characteristics of the putter head in accordance with the object of the invention, namely the design of a putter head wherein the center of gravity is pushed towards the rear of the device. This stepped feature is also pleasing from an aesthetic point of view.

As illustrated in FIG. 3 the assembled putter head 3 is adapted for attachment to a shaft through threaded bore 6. FIG. 4 illustrates the assembled putter head attached to a shaft 8. The bore is positioned such that when the shaft is attached, two-thirds of the shaft circumference extend into the back portion and one-third extends into the front portion of the putter head.

What is claimed is:

1. A golf putter, comprising:

a shaft;

a back portion; and, a front portion being made of a substantially lower density material than said back portion, said front portion being superimposed upon said back portion and substantially defining a striking face of said putter head, with said shaft extending into a putter head comprised of said front portion and said back portion and so that two-thirds of a circumference of said shaft extends into said back portion of said putter head and one-third of said circumference of said shaft extends into said front portion.

2. The golf putter according to claim 1, wherein said front portion is made of a polymer selected from the group consisting of melamine-formaldehyde, phenol formaldehyde, a polyester, an acrylic, a polyurethane, an epoxy material, a high pressure laminate and a combination thereof, and a filling material for said polymer.

3. The golf putter according to claim 2, wherein said filling material is selected from the group consisting of cellulose, aluminum trihydrate, calcium carbonate, talc and dolomite.

4. The golf putter according to claim 1, wherein said front portion comprises 25% phenolic resin and 75% cellulose.

5. The golf putter according to claim 1, wherein said front portion has a thickness of from 5 mm to 15 mm.

6. The golf putter according to claim 1, wherein said back portion has a thickness of from 10 mm to 20 mm.

7. The golf putter according to claim 1, wherein said putter head has a total weight of 250 g to 300 g, with said front portion having a weight of from 45 g to 55 g, and with said front portion having a specific gravity of 1.4 and said back portion having a specific gravity of 8.

8. A putter head suitable for attachment to a shaft, comprising:

a back portion; and, a front portion being only partially supported by said back portion, said front portion comprising a polymer and being made of a substantially lower density material than said back portion, said front portion being superimposed upon said back portion and defining a striking face for said putter head.

9. The putter head according to claim 8, wherein said polymer of said front portion is selected from the group consisting of melamine-formaldehyde, phenol formaldehyde, a polyester, an acrylic, a polyurethane, an epoxy material, a high pressure laminate and a combination thereof, and a filling material for said polymer.

10. The putter head according to claim 9, wherein said filling material is selected from the group consisting of cellulose, aluminum trihydrate, calcium carbonate, talc and dolomite.

11. The putter head according to claim 8, wherein said front portion comprises 25% phenolic resin and 75% cellulose.

12. The putter head according to claim 8, wherein said front portion has a thickness of from 5 mm to 15 mm.

13. The putter head according to claim 12, wherein said front portion has a thickness of 10 mm.

14. The putter head according to claim 8, wherein said back portion is made of metal.

15. The putter head according to claim 8, wherein said back portion has a thickness of from 10 mm to 20 mm.

16. The putter head according to claim 15, wherein said back portion has a thickness of 16 mm.

17. The putter head according to claim 8, wherein said putter head has a total weight of 250 g to 300 g, with said front portion having a weight of from 45 g to 55 g.

18. The putter head according to claim 17, wherein said putter head has a total weight of 285 g, with said front portion having a weight of 50 g.

19. The putter head according to claim 8, wherein said front portion has a specific gravity of 1.4 and said back portion has a specific gravity of 8.

20. The putter head according to claim 8, wherein said back portion has a trough shape.

21. The putter head according to claim 20, wherein said back portion has a stepped portion in each side of its said trough shape.

22. The putter head according to claim 21, wherein said stepped portion comprises two steps in each said side of said trough shape.

23. The putter head according to claim 8, wherein said front portion has a ridge extending along its length for aligning said front portion and said back portion when securing said front portion and said back portion to one another.

* * * * *